US007569984B2

(12) United States Patent
Yang et al.

(10) Patent No.: US 7,569,984 B2
(45) Date of Patent: Aug. 4, 2009

(54) WHITE-LIGHT FLUORESCENT LAMP HAVING LUMINESCENCE LAYER WITH SILICON QUANTUM DOTS

(75) Inventors: Tsun-Neng Yang, Taipei (TW); Chien-Te Ku, Pingjhen (TW)

(73) Assignee: Atomic Energy Council-Institute of Nuclear Energy Research, Taoyuan (TW)

( * ) Notice: Subject to any disclaimer, the term of this patent is extended or adjusted under 35 U.S.C. 154(b) by 415 days.

(21) Appl. No.: 11/454,949

(22) Filed: Jun. 19, 2006

(65) Prior Publication Data

US 2009/0167146 A1 Jul. 2, 2009

(51) Int. Cl.
*H01J 1/62* (2006.01)
*H01J 9/24* (2006.01)

(52) U.S. Cl. ..... 313/496; 313/309; 313/351; 445/24

(58) Field of Classification Search ..... 313/495, 313/496, 309, 351; 445/24
See application file for complete search history.

(56) References Cited

U.S. PATENT DOCUMENTS

| | | | | |
|---|---|---|---|---|
| 5,607,876 | A * | 3/1997 | Biegelsen et al. | 438/45 |
| 5,882,779 | A * | 3/1999 | Lawandy | 313/467 |
| 7,279,832 | B2 * | 10/2007 | Thurk et al. | 313/503 |
| 2002/0149015 | A1 * | 10/2002 | Choi et al. | 257/59 |
| 2004/0036130 | A1 * | 2/2004 | Lee et al. | 257/409 |
| 2004/0147050 | A1 * | 7/2004 | Novet et al. | 438/20 |
| 2005/0194889 | A1 * | 9/2005 | Chen et al. | 313/495 |
| 2008/0048554 | A1 * | 2/2008 | Yang et al. | 313/503 |

FOREIGN PATENT DOCUMENTS

JP 2008198614 A * 8/2008

* cited by examiner

*Primary Examiner*—Peter Macchiarolo
(74) *Attorney, Agent, or Firm*—Troxell Law Office PLLC

(57) ABSTRACT

A structure is formed by putting glass plates between a luminescence generating device and an electron emitting device so that a vacuum is formed in between. After in putting a high-voltage, an electron beam is emitted from the electron emitting device using low power. In the end, silicon quantum dots in the luminescence generating device are excited to generate a white light. The present invention has a good optoelectronic transformation efficiency.

17 Claims, 7 Drawing Sheets

WHITE-LIGHT FLUORESCENT LAMP HAVING LUMINESCENCE LAYER WITH SILICON QUANTUM DOTS

FIELD OF THE INVENTION

The present invention relates to a white-light lamp; more particularly, relates to exciting a luminescence layer having silicon quantum dots by an electron beam to obtain a white light.

DESCRIPTION OF THE RELATED ART(S)

A first prior art, called "A white light emitting diode," is proclaimed in Taiwan, comprising a light emitting source, emitting a light having a wavelength between 440 nanometers (nm) to 490 nm; and a phosphor, comprising a yellow phosphor and a red phosphor, where the yellow phosphor is made of $(Me_{1-x-y}Eu_xRe_y)_3SiO_5$; and the red phosphor is made of $Y_2O_3:Eu^{3+}$, $Y_2O_3:Bi^{3+}$, $(Y,Gd)_2O_3:Eu^{3+}$, $(Y,Gd)_2O_3:Bi^{3+}$, $Y_2O_2S:Bi^{3+}$, $(Me_{1-x}Eu_x)ReS$ or $Mg_3SiO_4:Mn$.

A second prior art is called "A white light emitting diode and a fabricating method thereof". The second prior art is a white-light emitting diode comprises a print circuit board (PCB), a plurality of white-light emitting diodes (LED), and a controller where the white LEDs are deposed on a side of the PCB; each white LED comprises a substrate, at least one blue LED on the substrate, and a mixed phosphor, mixed with a red phosphor, a green phosphor and a yellow phosphor; the mixed phosphor is covered on the outside of the blue LED; the red phosphor is made of CaS:Eu; the green phosphor is made of $SrGa_2S_4:Eu$ or $Ca_8EuMnMg(SiO_4)_4Cl_2$; the yellow phosphor is made of YAG:Ce or TbAG:Ce; and the controller is deposed on another side of the PCB to apply different current to each white LED to adjust color temperature.

A third prior art, "A white-light emitting device and a fabricating method thereof," is revealed in Taiwan, comprising a LED, a first phosphor and a second phosphor, where the LED emits an ultra-violet light; the first phosphor is excited by the ultra-violet light from the LED to generate a cyan fluorescent light having a wavelength between 470 nm and 500 nm; the first phosphor is made of $(Ba_{1-x-y}Eu_xSr_y)MgAl_{10}O_{17}$ with x greater than 0 and not greater than 1 and y not smaller than 0 and not greater than 1; the second phosphor is excited by the ultra-violet light from the LED to generate an orange light having a wavelength between 570 nm and 600 nm; the second phosphor is made of $(Ca,Eu,Mn)(PO_4)_3Cl$; and a white light is obtained by mixing the cyan light and the orange light.

A fourth prior art is called "A white light emitting device", comprising a LED, a first phosphor and a second phosphor, where the LED emits blue light or cyan light; the first phosphor is made of $(Y_xM_yCe_z)Al_5O_{12}$; x plus y equals 3 and x and y not equals to 0; z is smaller than 0.5 and greater than 0; M is Tb, Lu or Yb; Ce is a luminescent center; the first phosphor is excited by the light from the LED to obtain a yellow light having a wavelength between 520 nm and 580 nm; the second phosphor is excited by the light from the LED to obtain a red light having a wavelength between 580 nm and 640 nm; and a white light is obtained by mixing the light from the LED with the yellow light and the red light.

Although the above prior arts generate white lights by exciting phosphors with lights, the optoelectronic transformation efficiency is low so that exciting light sources using high power, or thick phosphor layer, are used. Hence, the prior arts do not fulfill users' requests on actual use.

SUMMARY OF THE INVENTION

The main purpose of the present invention is to excite a luminescence layer having silicon quantum dots by an electron beam from a low-power electron emitting device to obtain a white light.

To achieve the above purpose, the present invention is a white-light fluorescent lamp having silicon quantum dots and a fabricating method thereof, where the white-light fluorescent lamp having silicon quantum dots comprises a luminescence generating device, an electron emitting device, at least one separating plate and a high-voltage circuit; the luminescence generating device comprises a first conductive substrate, a luminescence layer having silicon quantum dots, and a metal film; the electron emitting device comprises a second conductive substrate and a nano-carbon tube layer; and the high-voltage circuit comprises a high-voltage source.

Therein, the present invention has a fabricating method of the white-light fluorescent lamp having silicon quantum dots, comprising steps of: (a) under a vacuum environment, deposing at least one separating plate between a luminescence generating device and an electron emitting device to form a package structure having a vacuum between the luminescence generating device and the electron emitting device; and (b) adding a high-voltage circuit outside of the package structure, having a high-voltage source with an anode end connecting to a first conductive substrate of the luminescence generating device and a cathode end connecting to a second conductive substrate of the electron emitting device.

Accordingly, a novel white-light fluorescent lamp having silicon quantum dots and a fabricating method thereof are obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 is a structural view showing the preferred embodiment according to the present invention;

DESCRIPTION OF THE PREFERRED EMBODIMENT

The following description of the preferred embodiment is provided to understand the features and the structures of the present invention.

Figure 1:
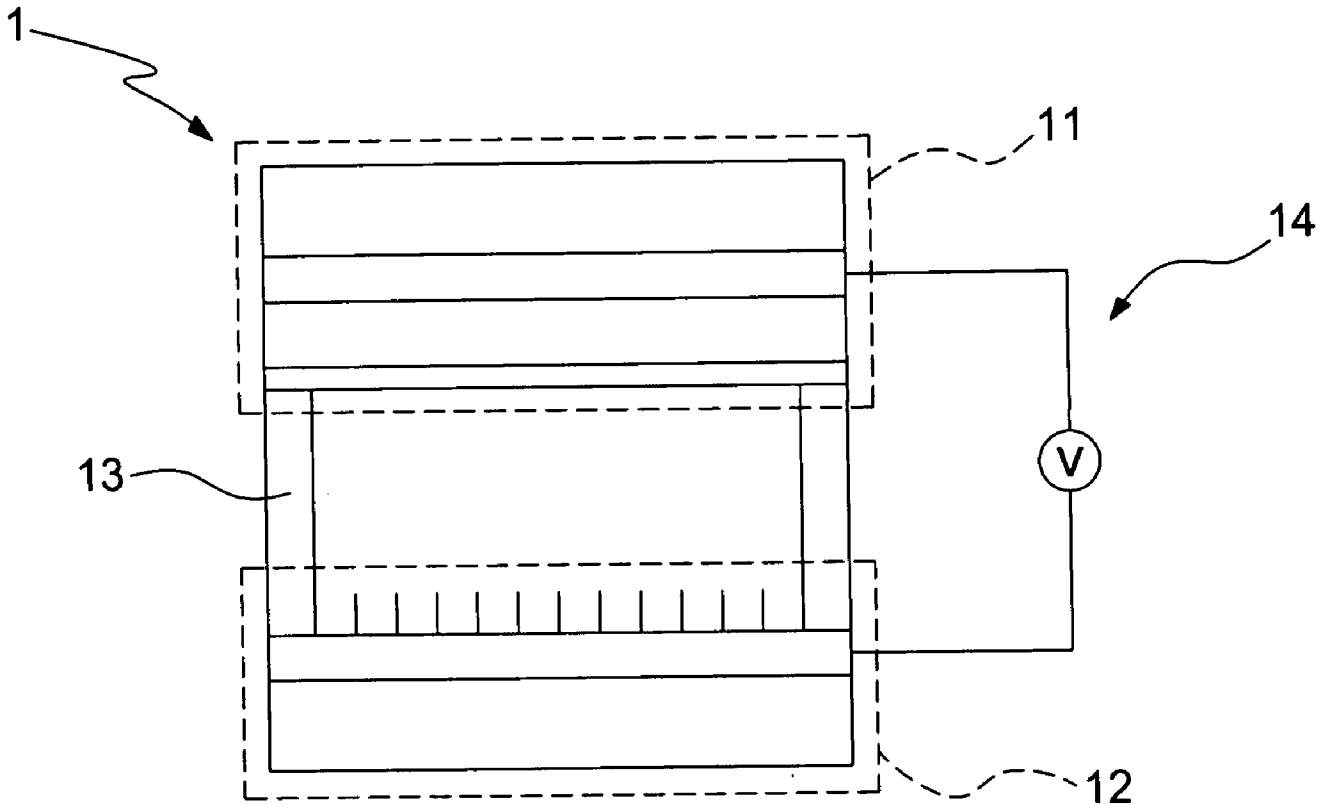
FIG. 1A is a structural view showing the luminescence generating device.
FIG. 1B is a structural view showing the electron emitting device.

Please refer to FIG. 1, which is a structural view showing a preferred embodiment according to the present invention. As shown in the figure, the present invention is a white-light fluorescent lamp having silicon quantum dots and a fabricating method thereof, where the white-light fluorescent lamp having silicon quantum dots 1 comprises a luminescence generating device 11, an electron emitting device 12, at least one separating plate 13 and a high-voltage circuit 14.

Figure 1A:
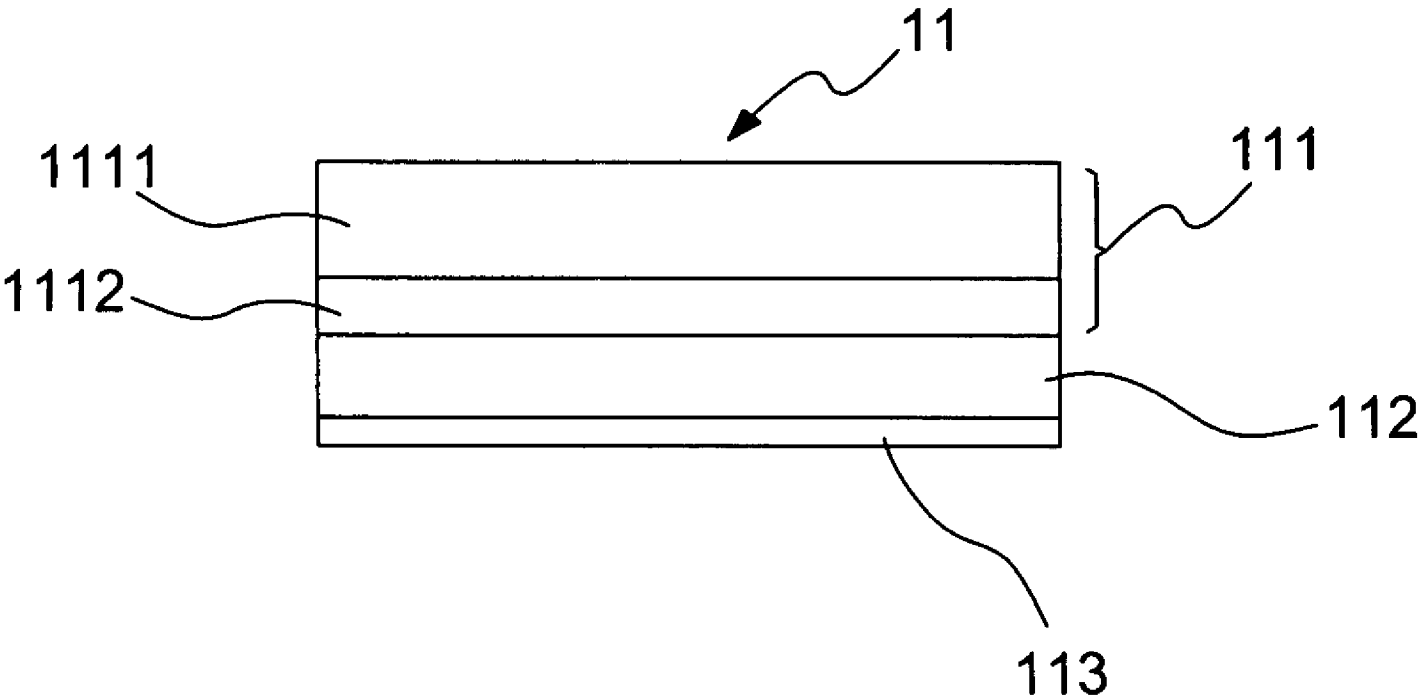

Please further refer to FIG. 1A, which is a structural views showing the luminescence generating device. As shown in the figure, the luminescence generating device 11 comprises a first conductive substrate 111, a luminescence layer having silicon quantum dots 112, and a metal film 113, where the luminescence layer having silicon quantum dots 112 is covered on the first conductive substrate 111 through a chemical vapor deposition or a screen printing process; the metal film 113 is covered on the luminescence layer having silicon quantum dots and is corresponding to the first conductive substrate 111; the first conductive substrate 111 is made of a substrate 1111, which has a transmission rate greater than 90 percents (%) and is covered with an indium tin oxide (ITO) layer 1112; the substrate 1111 is made of a glass; the luminescence layer having silicon quantum dots 1112 is obtained through embedding silicon quantum dots, each having a granular diameter between 1 nanometer (nm) and 10 nm, into an organic or inorganic luminescent material by using a physical or chemical method; the inorganic luminescent material is silicon dioxide, silicon nitride or silicon carbide; the metal film 113 is an aluminum film or a gold film; and the metal film 113 is used as a reflective glass and an anode material to increase electron number and to dissipate heat.

Figure 1B:
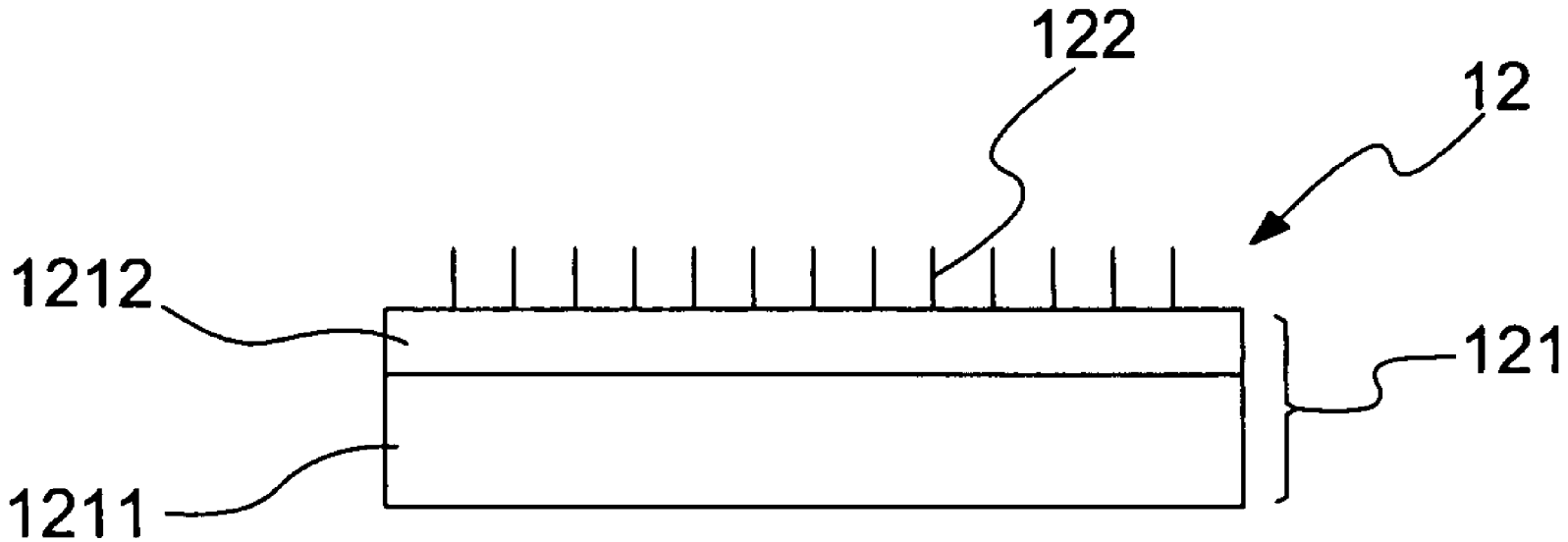

Please further refer to FIG. 1B, which is a structural views showing the electron emitting device. As shown in the figure, the electron emitting device 12 comprises a second conductive substrate 121 and a nano-carbon tube layer 122, where the nano-carbon tube layer 122 is covered on the second conductive substrate 121 through a chemical vapor deposition or a screen printing process; the second conductive substrate 121 is made of a substrate 1211, which has a transmission rate greater than 90% and is covered with an ITO layer 1212; the substrate 1111 is made of a glass or a silicon block; and the nano-carbon tube layer 122 is an electron emitting source.

The separating plate 13 is made of a material having a transmission rate greater than 90%; the material is a glass; and the separating plate 13 is located between the luminescence generating device 11 and the electron emitting device 12 to obtain a vacuum.

The high-voltage circuit 14 comprises at least one high-voltage source 141, where an anode end 1411 of the high-voltage source 141 is connected to the first conductive substrate 111 of the luminescence generating device 11 and a cathode end 1412 of the high-voltage source 141 is connected to the second conductive substrate 121 of the electron emitting device 12.

Thus, a novel white-light fluorescent lamp having silicon quantum dots is obtained.

Figure 2A:
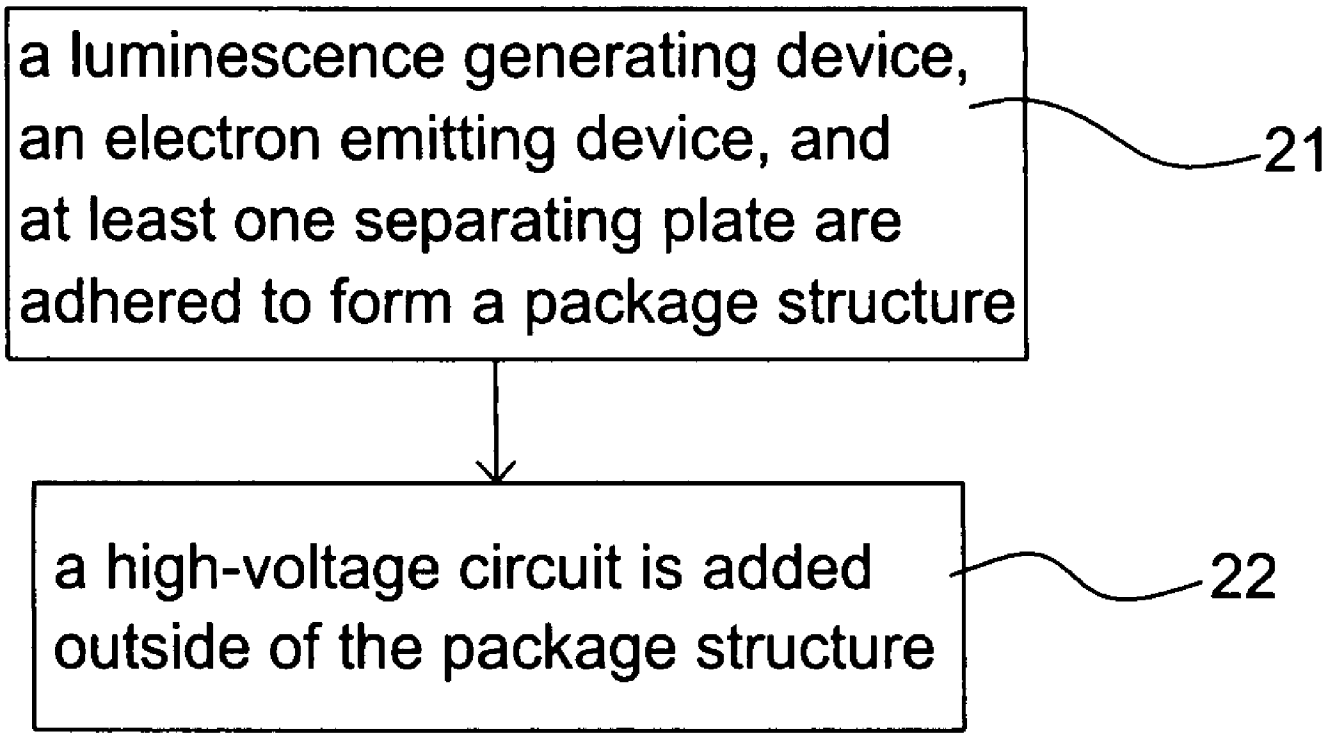
FIG. 2A is a flow view showing the fabricating method.
Figure 2B:
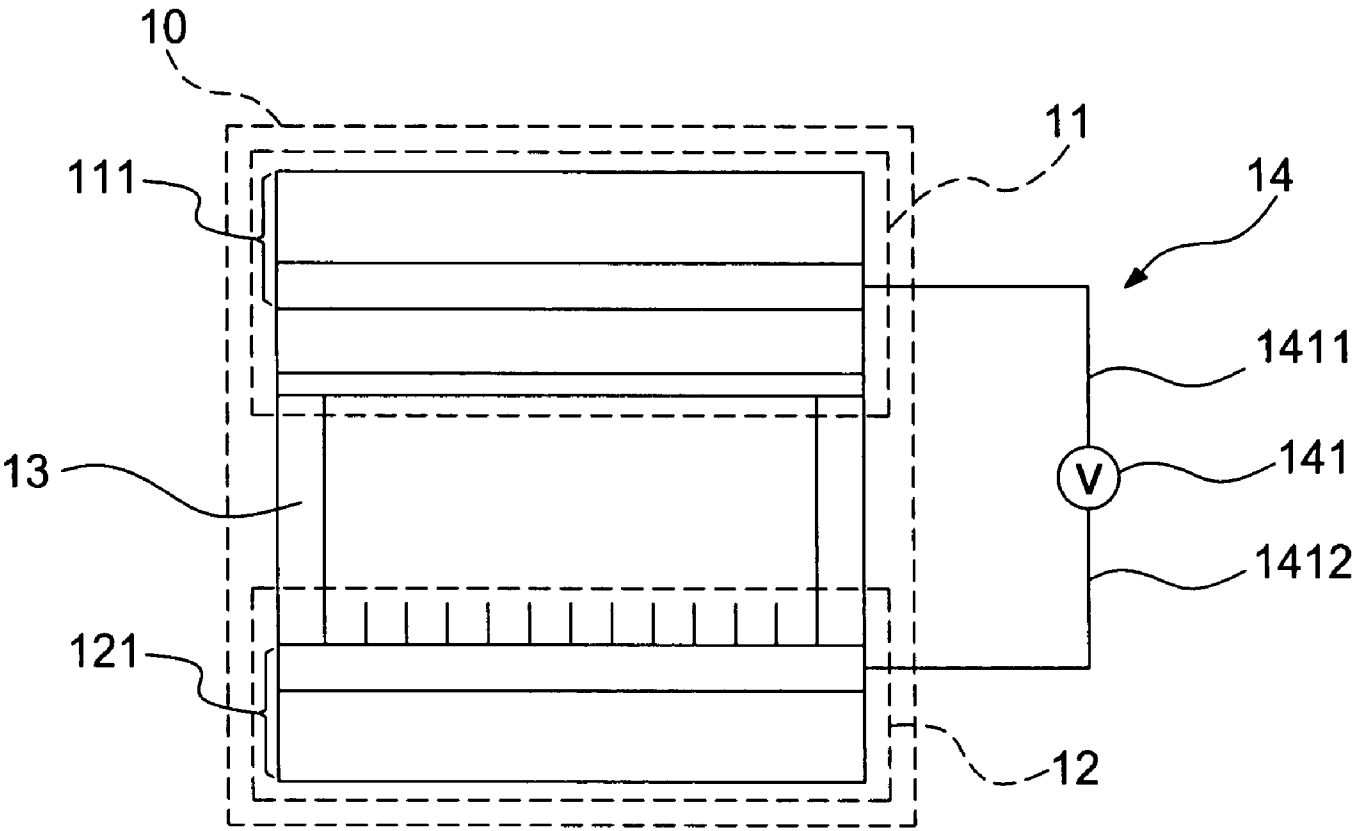
FIG. 2B is another structural view showing the preferred embodiment.

Please refer to FIG. 2A and FIG. 2B which are a flow view showing a fabricating method and another structural view showing the preferred embodiment. As shown in the figures, the fabricating method of a white-light fluorescent lamp having silicon quantum dots comprises the following steps:

(a) Forming a package structure 21: Under a vacuum environment, a luminescence generating device 11, an electron emitting device 12 and at least one separating plate 13 are adhered to form a package structure 10 by using an adhesive.

(b) Adding a high-voltage circuit 22: A high-voltage circuit 14 is added outside of the package structure 10, comprising at least one high-voltage source 141, where an anode end 1411 of the high-voltage source 141 connects to a first conductive substrate 111 of the luminescence generating device 11 and a cathode end 1412 of the high-voltage source 141 connects to a second conductive substrate 121 of the electron emitting device 12.

Thus, a novel white-light fluorescent lamp having silicon quantum dots is obtained.

Figure 3A:
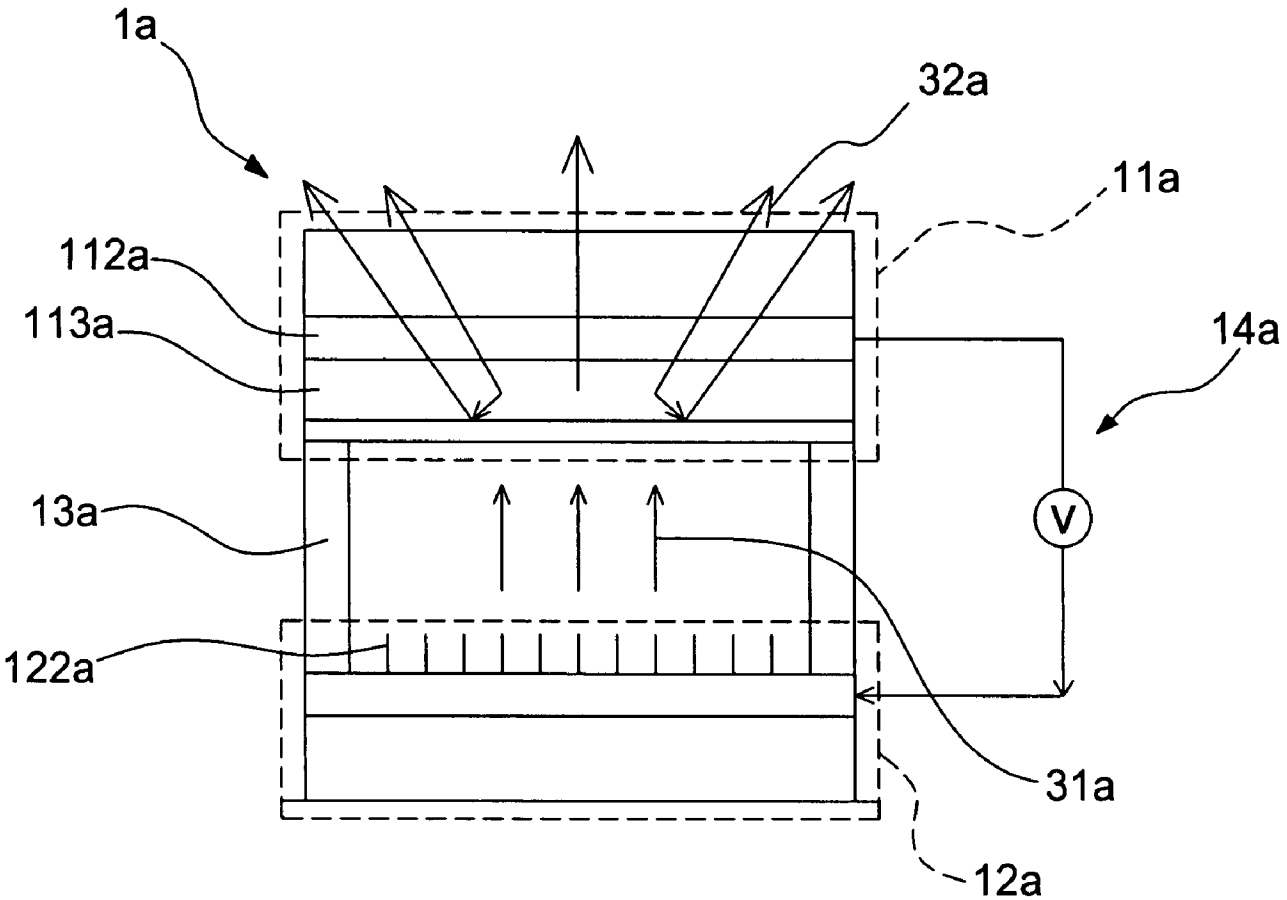
FIG. 3A is a view showing the first state of use.

Please refer to FIG. 3A, which is a view showing the first state of use. As shown in the figure, a white-light fluorescent lamp having silicon quantum dots 1*a* according to the present invention comprises a luminescence generating device 11*a*, an electron emitting device 12*a*, at least one separating plate 13*a* and a high-voltage circuit 14*a*. When a current runs in the high-voltage circuit 14*a*, a nano-carbon tube layer 122*a* of the electron emitting device 12*a* emits an energetic electron beam 31*a* to the luminescence generating device 11*a*. The electron beam 31*a* penetrates through a metal film 113*a* of the luminescence generating device 11*a* so that silicon quantum dots in a luminescence layer having the silicon quantum dots 112*a* are excited to obtain a visible light source 32*a*.

Figure 3B:
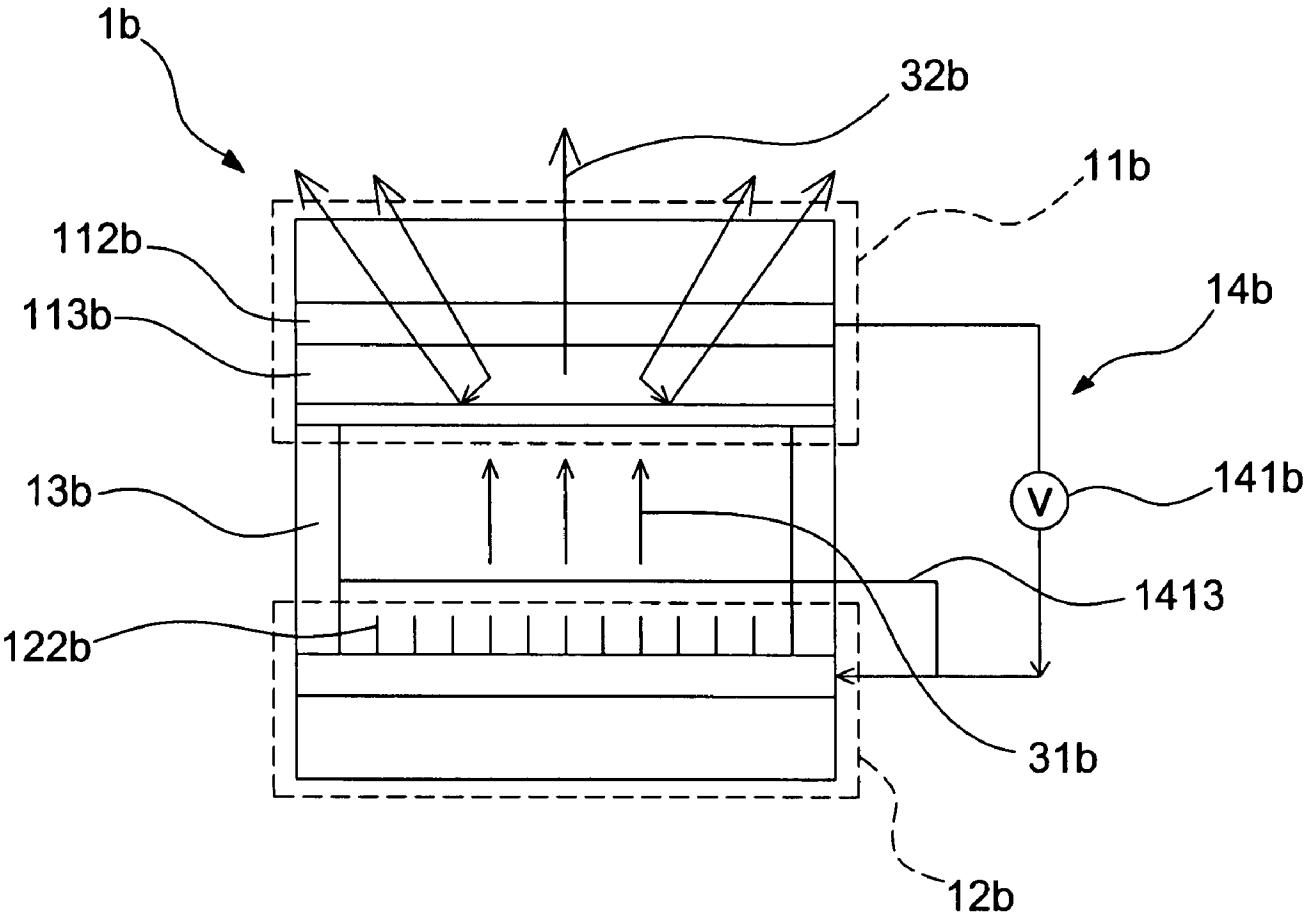
FIG. 3B is a view showing the second state of use.

Please refer to FIG. 3B, which is a view showing the second state of use. As shown in the figure, a white-light fluorescent lamp having silicon quantum dots 1*b* according to the present invention comprises a luminescence generating device 11*b*, an electron emitting device 12*b*, at least one separating plate 13*b* and a high-voltage circuit 14*b*, where a grid 1413 is added to the high-voltage circuit 14*b* between the luminescence generating device 11*b* as an anode and the electron emitting device 12*b* as a cathode. When a current runs in the high-voltage circuit 14*b*, a nano-carbon tube layer 122*b* of the electron emitting device 12*b* emits an energetic electron beam 31*b* through the grid 1413 so that a field effect is happened between the grid 1413 and the electron emitting device 12*a* as the cathode, and the nano-carbon tube layer 122*b* becomes an electron emission source. The electron beam 31*b* passes through the grid 1413. Owing to the lowering-down of the electric potential between the grid 1413 and the luminescence generating device 11*b* as an anode, the electron beam 31*b* accelerates to pass through a metal film 113*b* of the luminescence generating device 11*b* and arrives at a luminescence layer having silicon quantum dots 112*b* so that the silicon quantum dots in the luminescence layer having silicon quantum dots 112*b* are excited to obtain a visible light source 32*b*.

To sum up, the present invention is a white-light fluorescent lamp having silicon quantum dots and a fabricating method thereof, where an electron emitting device generates an electron beam to excite a fluorescent layer to obtain a white light source with an improved optoelectronic transformation efficiency.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A white-light fluorescent lamp having silicon quantum dots, comprising:

a luminescence generating device, said luminescence generating device comprising a first conductive substrate; a luminescence layer having silicon quantum dots; and a metal film, wherein said luminescence layer having silicon quantum dots both overlies and directly contacts an upper surface of said metal film;

an electron emitting device, said electron emitting device comprising a second conductive substrate and a carbon nanotube layer;

at least one separating plate, said separating plate being located between said luminescence generating device and said electron emitting device to obtain a vacuum between said luminescence generating device and said electron emitting device; and a high-voltage circuit, said high-voltage circuit comprising at least one high-voltage source, an anode end of said high-voltage circuit connecting to said first conductive substrate, a cathode end of said high-voltage circuit connecting to said second conductive substrate.

2. The white-light fluorescent lamp according to claim 1, wherein said luminescence layer having silicon quantum dots is deposed on said first conductive substrate through a method selected from a group consisting of a chemical vapor deposition and a screen printing process; and wherein said metal film is corresponding to said first conductive substrate and is deposed on said luminescence layer having silicon quantum dots.

3. The white-light fluorescent lamp according to claim 1, wherein said first conductive substrate comprises a substrate covered with an Indium Tin Oxide (ITO) layer; and wherein said substrate of said first conductive layer has a transmission rate greater than 90 percents (%).

4. The white-light fluorescent lamp according to claim 3, wherein said substrate of said first conductive layer is made of a glass.

5. The white-light fluorescent lamp according to claim 1, wherein said luminescence layer having silicon quantum dots is obtained through embedding silicon quantum dots into a luminescent material by using a method;

wherein each of said silicon quantum dots has a granular diameter between 1 nanometer (nm) and 10 nm;

wherein said luminescent material is selected from a group consisting of an organic luminescent material and an inorganic luminescent material;

wherein said method is selected from a group consisting of a physical method and a chemical method.

6. The white-light fluorescent lamp according to claim 5, wherein said inorganic luminescent material is selected from a group consisting of silicon dioxide, silicon nitride and silicon carbide.

7. The white-light fluorescent lamp according to claim 1, wherein said metal film is selected from a group consisting of an aluminum film and a gold film.

8. The white-light fluorescent lamp according to claim 1, wherein said second conductive substrate is a substrate deposited with an ITO layer; and wherein said substrate has a transmission rate greater than 90%.

9. The white-light fluorescent lamp according to claim 8, wherein said substrate is made of a material selected from a group consisting of a glass and a silicon block.

10. The white-light fluorescent lamp according to claim 1, wherein said nano-carbon tube layer is deposed on said second conductive substrate through a method selected from a group consisting of a chemical vapor deposition and a screen printing process.

11. The white-light fluorescent lamp according to claim 1, wherein said separating plate is made of a material having a transmission rate greater than 90%.

12. The white-light fluorescent lamp according to claim 11, wherein said material is a glass.

13. The white-light fluorescent lamp according to claim 1, wherein said high-voltage circuit further comprises a grid; and wherein said grid is located between said luminescence generating device and said electron emitting device.

14. The white-light fluorescent lamp according to claim 1, wherein said white-light fluorescent lamp has a fabricating method comprising steps of:

(a) under a vacuum environment, processing a packaging process to obtain a package structure through adhering a luminescence generating device, an electron emitting device and at least one separating plate by using an adhesive; and (b) locating a high-voltage circuit outside of said package structure, wherein said high-voltage circuit comprises at least one high-voltage source;

wherein said high-voltage circuit has an anode end connecting to said luminescence generating device; and wherein said high-voltage circuit has a cathode connecting to said electron emitting device.

15. The white-light fluorescent lamp according to claim 14, wherein said luminescence generating device comprises a first conductive substrate;

a luminescence layer having silicon quantum dots; and a metal film;

wherein said luminescence layer having silicon quantum dots is deposed on said first conductive substrate through a method selected from a group consisting of a chemical vapor deposition and a screen printing process; and wherein said metal film is corresponding to said first conductive substrate and is deposed on said luminescence layer having silicon quantum dots.

16. The white-light fluorescent lamp according to claim 14, wherein said electron emitting device comprises a second conductive substrate and a carbon nanotube layer;

wherein said carbon nanotube layer is deposed on said second conductive substrate through a method selected from a group consisting of a chemical vapor deposition and a screen printing process.

17. The white-light fluorescent lamp according to claim 14, wherein said high-voltage circuit has an anode end connecting to a first conductive substrate of said luminescence generating device and a cathode end connecting to a second conductive substrate of said electron emitting device.

* * * * *